US009380376B2

(12) United States Patent
Uggla

(10) Patent No.: US 9,380,376 B2
(45) Date of Patent: Jun. 28, 2016

(54) HEADBAND COVER FOR A HEADBAND OF A HEADPHONE

(71) Applicant: Zound Industries International AB, Stockholm (SE)

(72) Inventor: Carl Johan Uggla, Stockholm (SE)

(73) Assignee: Zound Industries International AB, Stockholm (SE)

( * ) Notice: Subject to any disclaimer, the term of this patent is extended or adjusted under 35 U.S.C. 154(b) by 0 days.

(21) Appl. No.: 14/750,153

(22) Filed: Jun. 25, 2015

(65) Prior Publication Data

US 2016/0050486 A1 Feb. 18, 2016

(30) Foreign Application Priority Data

Aug. 15, 2014 (SE) ..... 1450950

(51) Int. Cl.
*H04R 25/00* (2006.01)
*H04R 1/10* (2006.01)
*H04R 5/033* (2006.01)

(52) U.S. Cl.
CPC ..... *H04R 1/1091* (2013.01); *H04R 5/0335* (2013.01)

(58) Field of Classification Search
CPC ..... H04M 1/05; H04R 1/105; H04R 1/1008; H04R 1/1016; H04R 1/1033; H04R 1/1066; H04R 1/1091; H04R 5/033; H04R 5/0335
USPC ..... 381/370, 374, 378, 379
See application file for complete search history.

(56) References Cited

U.S. PATENT DOCUMENTS

| | | | | |
|---|---|---|---|---|
| 8,861,766 | B2 * | 10/2014 | Ouryouji | H04R 1/1058 381/370 |
| 2005/0089185 | A1 * | 4/2005 | Allen | H04R 1/1008 381/370 |
| 2010/0277944 | A1 * | 11/2010 | Hurwitz | A41D 27/08 29/428 |
| 2013/0136293 | A1 | 5/2013 | Lee et al. | |
| 2014/0036127 | A1 | 1/2014 | Pong et al. | |
| 2014/0177884 | A1 | 6/2014 | Minarik et al. | |
| 2014/0348371 | A1 | 11/2014 | Ishizaki | |

FOREIGN PATENT DOCUMENTS

| | | | |
|---|---|---|---|
| EP | 2566191 | A2 | 3/2013 |
| FR | 2 976 756 | A1 | 12/2012 |
| JP | 2009-125424 | A | 6/2009 |
| KR | 20120082068 | A | 7/2012 |
| WO | WO 2013/099417 | A1 | 7/2013 |

OTHER PUBLICATIONS

Audio Equip, "New! Replacement Upgrade Headband Comfort Cushion Pad . . .", First available on Amazon May 25, 2012; http://www.amazon.com/gp/product/B00862522A?keywords=headband%20cover&qid=1458139003&ref_=sr_1_2&s=electronics&sr=1-2, Retrtieved Mar. 16, 2016.*

International Search Report in PCT Application No. PCT/SE2015/050738, dated Oct. 27, 2015.

(Continued)

*Primary Examiner* — Brian Ensey
(74) *Attorney, Agent, or Firm* — Knobbe, Martens, Olson & Bear, LLP

(57) ABSTRACT

The present disclosure generally relates to a headband cover for a headphone. In one embodiment, a headphone comprises a headband having an interchangeable headband cover folded around the headband of the headphone.

19 Claims, 10 Drawing Sheets

(56) References Cited

OTHER PUBLICATIONS

HeadphoneMate: "How to apply HeadphoneMate(TM) UltraCushion replacement headband for Bose OC2 and 15 headphones", Mar. 30, 2013, XP054976269, Retrieved from the Internet: URL:https://www.youtube.com/watch?v=fBNAkEURLYM [retrieved on Dec. 17, 2015].

Extended European Search Report in Application No. EP 15 17 3739.2, dated Jan. 5, 2016.

* cited by examiner

HEADBAND COVER FOR A HEADBAND OF A HEADPHONE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims the benefit of priority to Swedish Patent Application Number 1450950-9, filed on Aug. 15, 2014, the contents of which are hereby incorporated by reference herein.

BACKGROUND

1. Field of the Invention

The present disclosure generally relates to a headband cover. More particularly, the present disclosure relates to a headband cover for detachable attachment to a headband of a headphone. The disclosure also presents a headband for a headphone as well as a headphone.

2. Description of the Related Art

Headphones are known in the art. FIG. 1 shows an example of a headphone 100. In the existing art, the headphone 100 typically comprises a headband 110. Typically, but not necessarily, the headband 110 is an arced headband. The headband 110 is configured to extend along a portion of a head of a user, or wearer, of the headphone 100. Each headband end 120 is provided with a respective earpiece 130. Each of the two earpieces 130 comprises respective speaker elements, etc. (not shown), as is common in the existing art. The earpieces 130 also provide a volume around the ears of the user such that the headphone may be worn conveniently by the user and such that the sound listening experience is satisfactory when using the headphone 100.

Recently, the fields of technology and fashion in the field of headphones have started to merge. Efforts have been made to personalize headphones such that the users of headphones may express and differentiate themselves. Unfortunately, commonly worn headphones continue to lack features enabling expression of individual taste and style. In an attempt to overcome this disadvantage, the United States Patent Application Publication US 2013/0136293 A1 proposes a headphone with an interchangeable décor strip.

SUMMARY

It is in view of the above considerations and others that the various embodiments of the present invention have been made.

It is a general object of the embodiments of the invention to allow for a headphone, which enables a user, or wearer, of a headphone to express his or her individual taste and/or style.

This general object has therefore been addressed by the appended independent claims. Advantageous embodiments are defined in the appended dependent claims.

According to a first aspect, a headband cover for detachable attachment to a headband of a headphone is provided. The headband is configured to extend along a portion of a head of a wearer of the headphone. The headband cover comprises a first headband cover unit. The headband cover also comprises a second headband cover unit, which is arranged along a first longitudinal side of the first headband cover unit. Furthermore, the headband cover comprises a third headband cover unit, which is arranged along a second longitudinal side of the first headband cover unit, the second longitudinal side being an opposite side to the first longitudinal side. The second headband cover unit is foldable along the first longitudinal side of the first headband cover unit. Also, the third headband cover unit is foldable along the second longitudinal side of the first headband cover unit. Thereby, the second and third headband units may be folded around the headband of the headphone to detachably attach the headband cover to the headband of the headphone.

An advantage with the headband cover according to the first aspect is that the headband cover is interchangeable. This enables a user, or wearer, to express his or her individual taste and/or style.

An advantage with an interchangeable headband cover is that the headband cover may be changed and/or washed. Many users, or wearers, of headphones use their headphones rather frequently. This means that the headband may become worn out, or soiled. However, if the headband cover according to the first aspect becomes worn out the user may change the worn-out headband cover to a new headband cover. Also, the user may wash a soiled headband cover and use the same headband cover after it is has been cleaned.

Preferably, but not necessarily, the first headband cover unit has a waist portion whose width, along a direction perpendicular to the first and second longitudinal sides, is wider than corresponding widths at respective outer portions of the first headband cover unit, the outer portions of the first headband cover unit being positioned at either side of the waist portion.

By providing a comparatively wider waist portion of the first headband cover unit (as compared to the widths of its outer portions) it is made possible to allow for an easier folding of the headband cover around the headband of the headphone.

In some embodiments, at least one of the first, second and third headband cover units has flexibility. For example, said at least one of the first, second and third headband cover units may comprise: a padding element; a bendable plastic element abutting against the padding element; and clothing covering the padding element and the bendable plastic element.

In some embodiments, all of the first, second and third headband cover units have flexibility. For instance, each of the first, second and third headband cover units may comprise: a padding element; a bendable plastic element abutting against the padding element; and clothing covering the padding element and the bendable plastic element.

By providing one or several headband cover units having flexibility it is made possible to allow for an easier folding of the headband cover around the headband of the headphone.

Furthermore, by providing a combination of the comparatively wider waist portion of the first headband cover unit and one or several headband cover units having flexibility it is made possible to allow for an even easier folding of the headband cover around the headband of the headphone. No, or very little, force has to be applied to the second and third headband cover units in order to fold the headband cover around the headband. Instead, the headband cover may naturally take a shape around the headband when the user folds the second and third headband cover units of the headband cover around the headband of the headphone. Moreover, once folded around the headband the headband cover may be relatively securely attached to the headband.

The above-mentioned padding element may be made of foam. The foam may, for example, be PU foam (PU is an abbreviation for polyurethane) or, alternatively, EVA foam (EVA is an abbreviation for Ethylene Vinyl Acetate).

The above-mentioned bendable plastic element may be made of polypropylene (PP), or any other flexible polymer material.

In some embodiments, the bendable plastic element is attached to the padding element by means of an adhesive.

Furthermore, the above-mentioned clothing may e.g. be made of fabric, leather, or artificial leather.

By providing a padding element, a bendable plastic element abutting against the padding (e.g., attached thereto by means of an adhesive), and clothing covering the padding element and the bendable plastic element it is e.g. made possible to provide a headband cover having suitable flexibility.

In some embodiments, the second headband cover unit comprises at least one fastener element; and the third headband cover unit also comprises at least one fastener element such that the second and third headband cover units may be securely attached to the headband of the headphone when the second and third headband units are folded around the headband of the headphone.

For example, said at least one fastener element may be a hook-and-loop fastener element. The hook-and-loop fastener element may be a fabric hook-and-loop fastener, such as Velcro.

Alternatively, said at least one fastener element may be a magnetic element, or magnet.

In some embodiments, a first width of the second headband cover unit corresponds to substantially half the length of a corresponding width of the first headband cover unit; and a second width of the third headband cover unit corresponds to substantially half the length of a corresponding width of the first headband cover unit; whereby the total length of said first and second widths substantially equals the corresponding width of the first headband cover unit when the second and third headband units are folded around the headband of the headphone.

According to a second aspect, a headband for a headphone is provided. The headband is configured to extend along a portion of a head of a wearer of the headphone. Furthermore, a headband cover according to the earlier-mentioned first aspect is detachably attached to the headband.

In some embodiments, the headband comprises at least two legs (i.e. two or more legs) that extend in a curvature corresponding to said portion of the head of the wearer of the headphone. One or several of the at least two legs may be a metal wire. In some embodiments, each of the at least two legs is a metal wire.

In some embodiments, each headband end of the headband is provided with hook-and-loop fastener elements configured to detachably attach with corresponding hook-and-loop fastener elements of the headband cover.

According to a third aspect, a headphone comprising a headband according to the earlier-mentioned second aspect is provided.

BRIEF DESCRIPTION OF THE DRAWINGS

These and other aspects, features and advantages will be apparent and elucidated from the following description of various embodiments, reference being made to the accompanying drawings, in which.

DETAILED DESCRIPTION

The present invention will now be described more fully hereinafter. The invention may, however, be embodied in many different forms and should not be construed as limited to the embodiments set forth herein; rather, these embodiments are provided by way of example so that this disclosure will be thorough and complete, and will fully convey the scope of the invention to those persons skilled in the art. Like reference numbers refer to like elements throughout the description.

Figure 1:
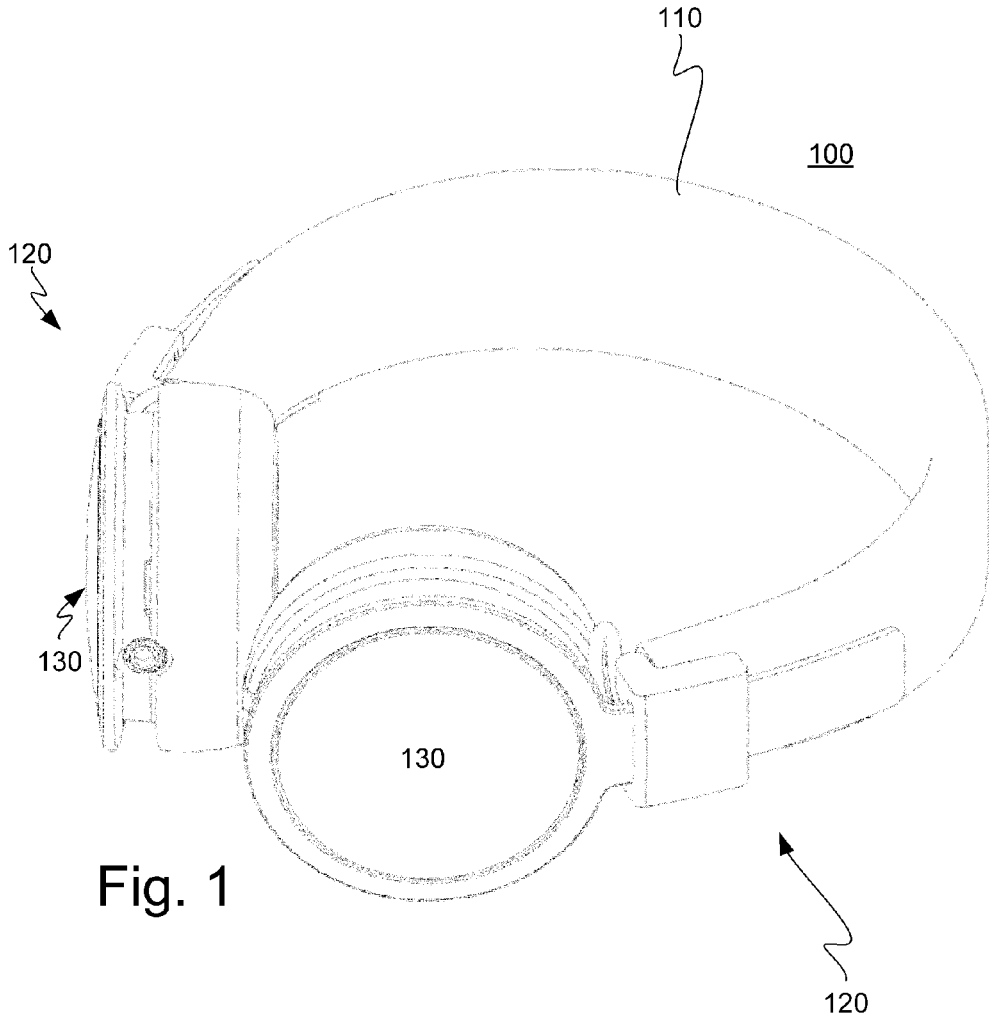
FIG. 1 shows a perspective view of a headphone.
Figure 2A:
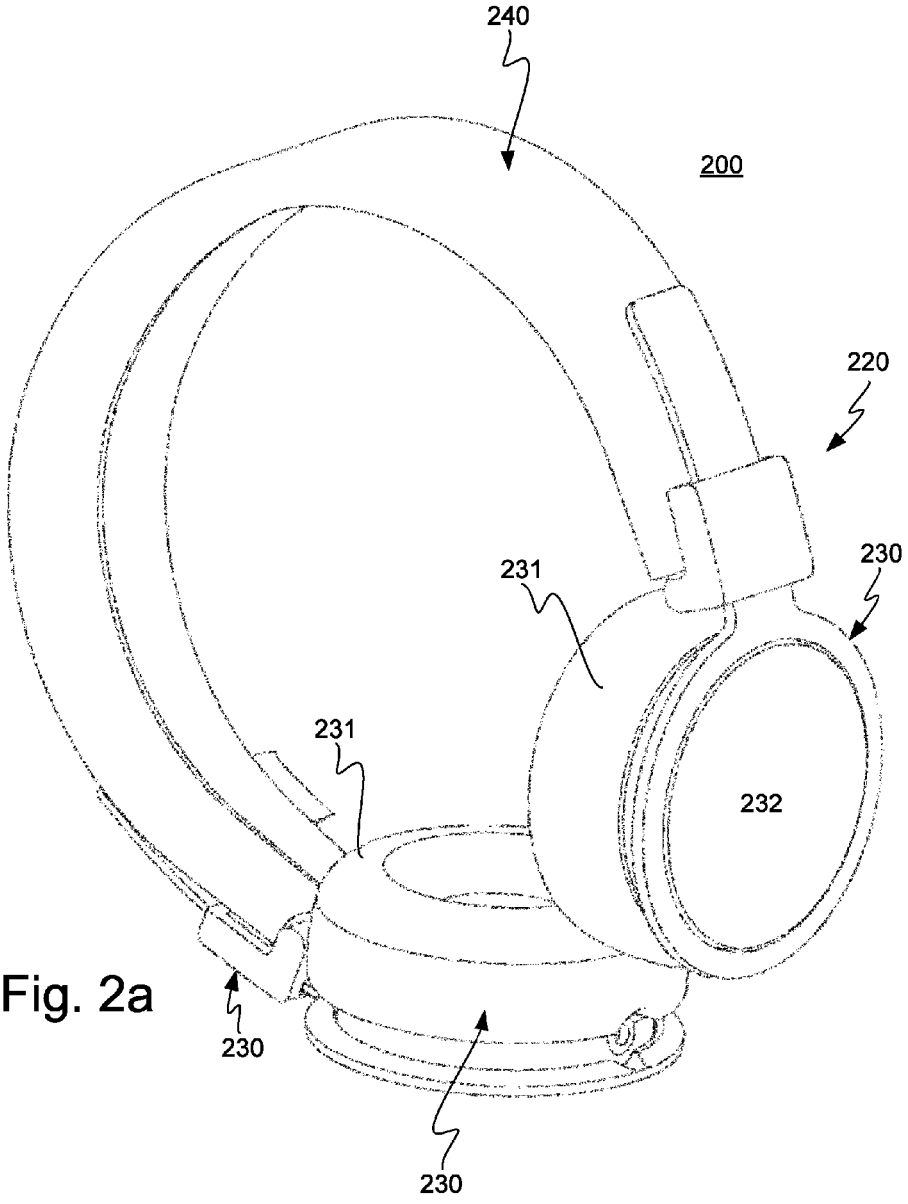
FIG. 2*a* shows a perspective view of a headphone according to an embodiment.
Figure 2B:
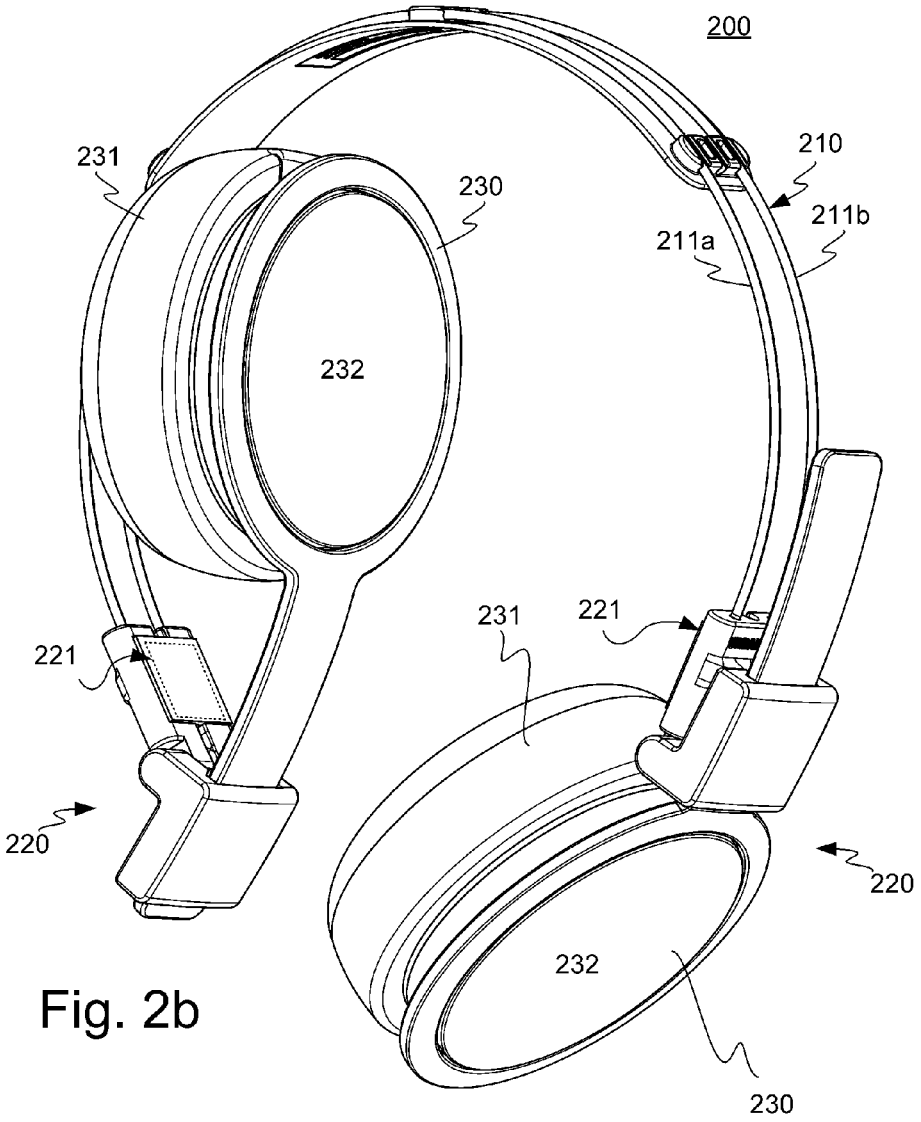
FIG. 2*b* shows a perspective view of the headphone of FIG. 2*a* without headband cover.

With reference to FIGS. 2*a-b*, a headphone 200 according to an example embodiment will be described. The headphone 200 comprises a headband 210 (see FIG. 2*b*). Typically, but not necessarily, the headband 210 is an arced headband. The headband 210 is configured to extend along a portion of a head of a user, or wearer, of the headphone 200. In other words, the headband 210 may be formed to a substantially U-shape or a substantially C-shape having a predetermined curvature so as to enable arrangement along a top portion of the head of the user.

As can be seen in FIG. 2*b*, the headband 210 may comprise two or more legs 211*a*, 211*b* that extend in the curvature corresponding to the top portion of the head of the wearer of the headphone. The leg 211*a* may be a metal wire. The leg 211*b* may also be a metal wire. Preferably, but not necessarily, both legs 211*a* and 211*b* are metal wires.

Each headband end 220 is provided with a respective earpiece 230. The headband 210 can be said to interconnect the two earpieces 230. Each of the two earpieces 230 comprises respective speaker elements (not shown) and optionally also other constructional components (not shown), as is conventional and known in the art.

The earpieces 230 provide a volume around the ears of the user such that the headphone may be worn conveniently by the user and such that the sound listening experience is satisfactory when using the headphone 200. To this end, each of the earpieces 230 may comprise a respective ear cushion 231 to be positioned close to the ears of the user. On the opposite side to the ear cushion 231, there may be a cover plate 232.

Typically, the speaker elements (not shown) and optionally also any other constructional components (not shown) are arranged in between the ear cushion 231 and the cover plate 232.

With continued reference to FIG. 2*a*, the headphone 200 is illustrated to include a headband cover 240. This headband cover 240 is configured to be folded around the headband 210. The headband cover 240 may e.g. be configured to be folded around the two or more legs 211*a*, 221*b* of the headband 210 along with the extension of said legs 211*a*, 211*b*. The headband cover 240 will now be further detailed with reference to FIGS. 3*a*-3*b*, FIGS. 4*a*-4*b*, FIGS. 5*a*-5*b*, FIGS. 6*a*-6*b*, and FIGS. 7*a*-7*b*, respectively.

Figure 3A:
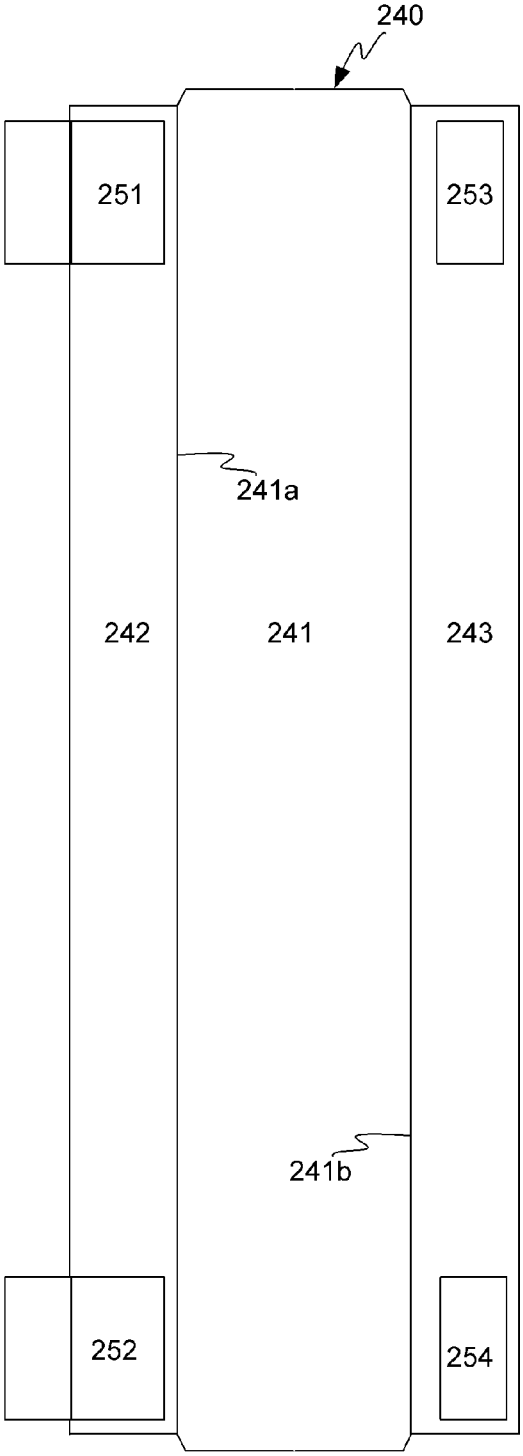
FIG. 3*a* shows a top view of a headband cover according to an embodiment (unfolded mode)
Figure 3B:
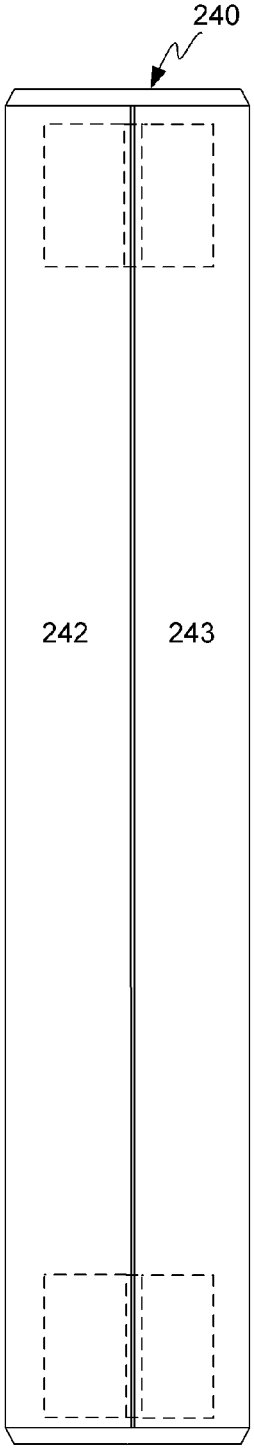
FIG. 3*b* shows a top view of the headband cover shown in FIG. 3*a* (folded mode)

FIGS. 3*a*-3*b* show top views of a headband cover 240 for detachable attachment to the headband 210 of the headphone 200 illustrated in FIGS. 2*a*-2*b*.

The headband cover 240 comprises a first headband cover unit 241, a second headband cover unit 242, and a third headband cover unit 243. The second headband cover unit 242 is arranged along a first longitudinal side 241*a* of the first headband cover unit 241. The third headband cover unit 243 is arranged along a second longitudinal side 241*b* of the first headband cover unit 241. The second longitudinal side 241*b* is an opposite side to the first longitudinal side 241*a*. In other words, the second longitudinal side 241*b* is positioned opposite to the first longitudinal side 241*a*.

Furthermore, the second headband cover unit 242 is foldable along the first longitudinal side 241*a* of the first headband cover unit 241. Also, the third headband cover unit 243 is foldable along the second longitudinal side 241*b* of the first headband cover unit 241. Thereby, the second and third headband units 242, 243 may be folded around the headband 210 of the headphone 200 to detachably attach the headband cover 240 to the headband 210 of the headphone 200, as is schematically illustrated in FIG. 2*a*.

An advantage with the headband cover 240 is that the headband cover 240 is interchangeable. This enables a user, or wearer, to express his or her individual taste and/or style. An advantage with an interchangeable headband cover 240 is that the headband cover 240 may be changed and/or washed. Many users, or wearers, of headphones use their headphones 200 rather frequently. However, if the headband cover 240 becomes worn out the user may change the worn-out headband cover 240 to a new headband cover 240. Also, the user may wash a soiled headband cover 240 and use the same headband cover 240 after it is has been cleaned.

Optionally, the second headband cover unit 242 may comprise one or several fastener elements 251, 252. Also, the third headband cover unit 243 may comprise one or several fastener elements 253, 254. Thereby, the second and third headband cover units 242, 243 may be securely attached to the headband 210 of the headphone 200 when the second and third headband units 242, 243 are folded around the headband 210 of the headphone 200.

In the embodiment illustrated in FIGS. 3*a*-3*b*, said one or several fastener elements are implemented by means of hook-and-loop fastener elements, such as fabric hook-and-loop fasteners (also colloquially known as Velcro). As can be seen in the folded mode of the headband cover in FIG. 3*b*, a hook-and-loop fastener element 251 of the second headband cover unit 241 may securely attach, or connect, to a corresponding hook-and-loop fastener element 253 of the third headband cover unit 243. Likewise, another hook-and-loop fastener element 252 of the second headband cover unit 241 may securely attach, or connect, to a corresponding hook-and-loop fastener element 254 of the third headband cover unit 243.

Figure 4A:
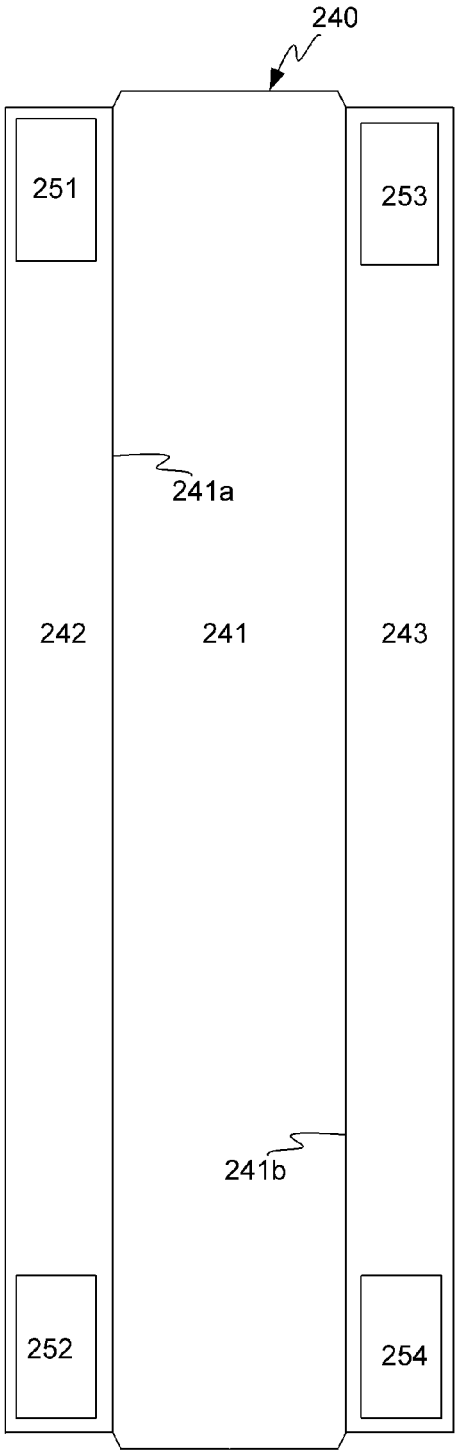
FIG. 4*a* shows a top view of a headband cover according to an embodiment (unfolded mode)
Figure 4B:
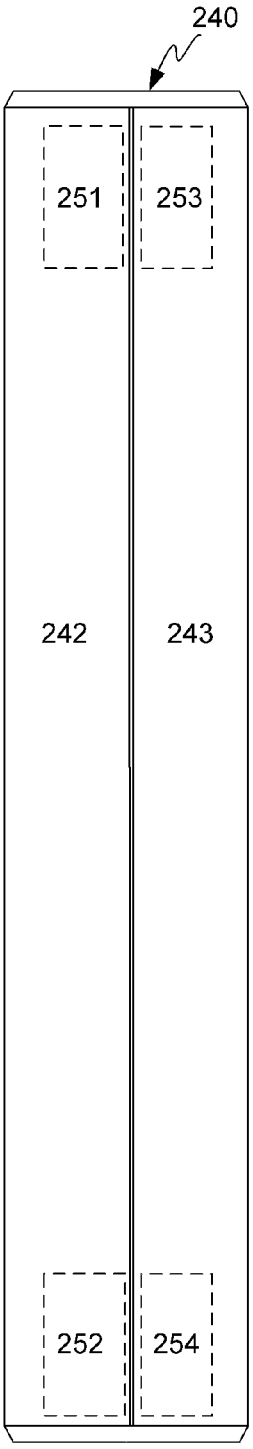
FIG. 4*b* shows a top view of the headband cover shown in FIG. 4*a* (folded mode)

In an alternative embodiment, which is illustrated in FIGS. 4*a*-4*b*, said one or several fastener elements are also implemented by means of hook-and-loop fastener elements, such as fabric hook-and-loop fasteners. In this embodiment, hook-and-loop fastener elements 251, 252, 253, 254 are configured to securely attach, or connect, to respective hook-and-loop fastener elements 221 (see FIG. 2*b*) provided at the headband 210. As is schematically illustrated in FIG. 2*b*, the headband 210 may thus optionally be provided with hook-and-loop fastener elements 221 at each headband end 220 such that the hook-and-loop fastener elements 251, 252, 253, 254 of the headband cover 240 may be securely attached, or connected, to the respective hook-and-loop fastener elements 221 of the headband 210. In an example embodiment, the hook-and-loop fastener elements 221 of the headband 210 may comprise Velcro hooks and the hook-and-loop fastener elements 251, 252, 253, 254 of the headband cover 240 may comprise Velcro loops.

Figure 5A:
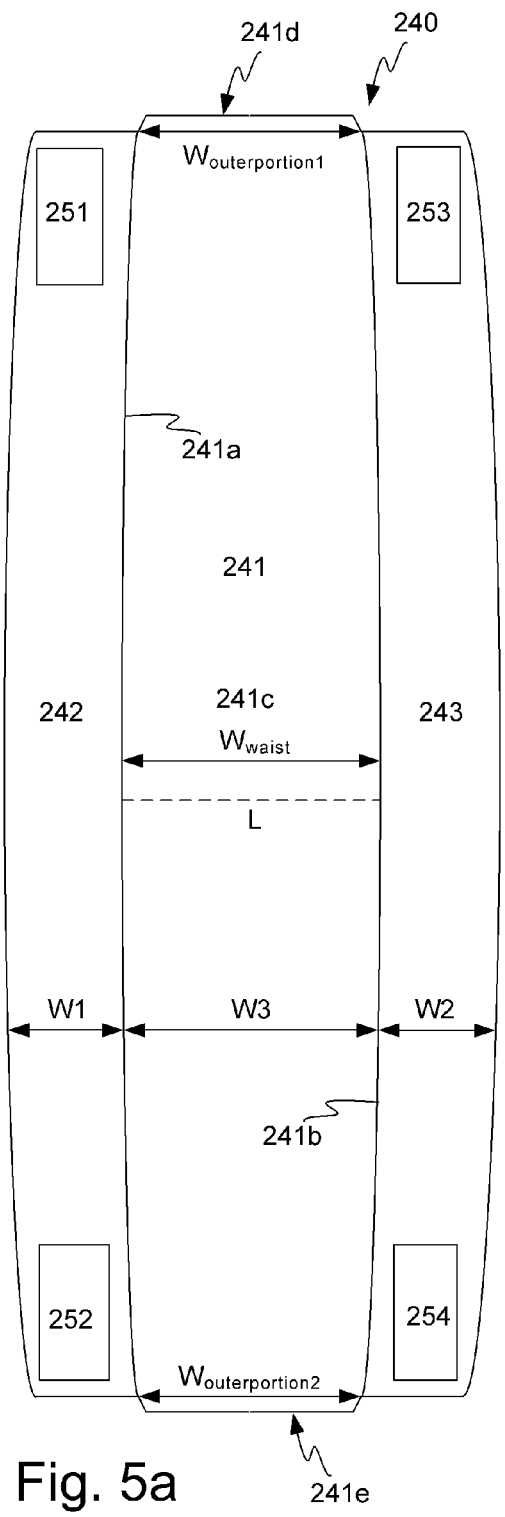
FIG. 5*a* shows a top view of a headband cover according to an embodiment (unfolded mode)
Figure 5B:
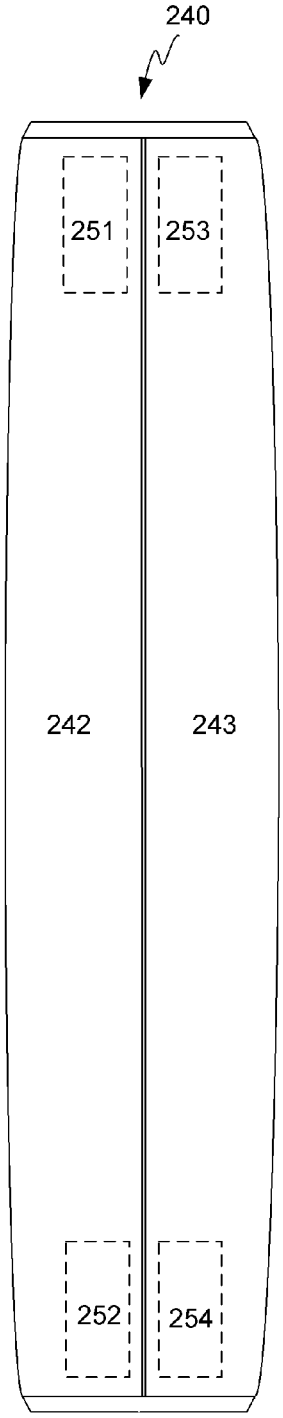
FIG. 5*b* shows a top view of the headband cover shown in FIG. 5*a* (folded mode)

FIGS. 5*a*-5*b* schematically illustrates that, in some embodiments, the first headband cover unit 241 may have a waist portion 241*c* whose width $W_{waist}$ (along a direction L perpendicular to the first and second longitudinal sides 241*a*, 241*b*) is comparatively wider than corresponding widths $W_{outerportion1}$ and $W_{outerportion2}$ at respective outer portions 241*d*, 241*e* of the first headband cover unit 241 (i.e., $W_{waist}>W_{outerportion1}$, $W_{waist}>W_{outerportion2}$. The outer portions 241*d*, 241*e* of the first headband cover unit 241 are positioned at either side of the waist portion 241*c*. Advantageously, but not necessarily, the width denoted $W_{outerportion1}$ may equal the width denoted $W_{outerportion2}$ (i.e., $W_{outerportion1}=W_{outerportion2}$). The exact lengths of the respective widths $W_{waist}$, $W_{outerportion1}$, and $W_{outerportion2}$ should be tested and evaluated for each specific case e.g. in dependence of certain user needs or demands.

As is schematically illustrated in FIG. 5*a*, a first width W1 of the second headband cover unit 242 may correspond to substantially half the length of a corresponding width W3 of the first headband cover unit 241. Also, a second width W2 of the third headband cover unit 243 may correspond to substantially half the length of a corresponding width W3 of the first headband cover unit 241. Thus, the total length of said first and second widths (i.e., W1+W2) may substantially equal the corresponding width W3 of the first headband cover unit 241 when the second and third headband units are folded (i.e., W1+W2=W3), see e.g. FIG. 5*b*.

By providing a comparatively wider waist portion $W_{waist}$ of the first headband cover unit 241 (as compared to the widths of its outer portions $W_{outerportion1}$ and $W_{outerportion2}$) it is made possible to allow for an easier folding of the headband cover 240 around the headband 210 of the headphone 200.

Figure 6A:
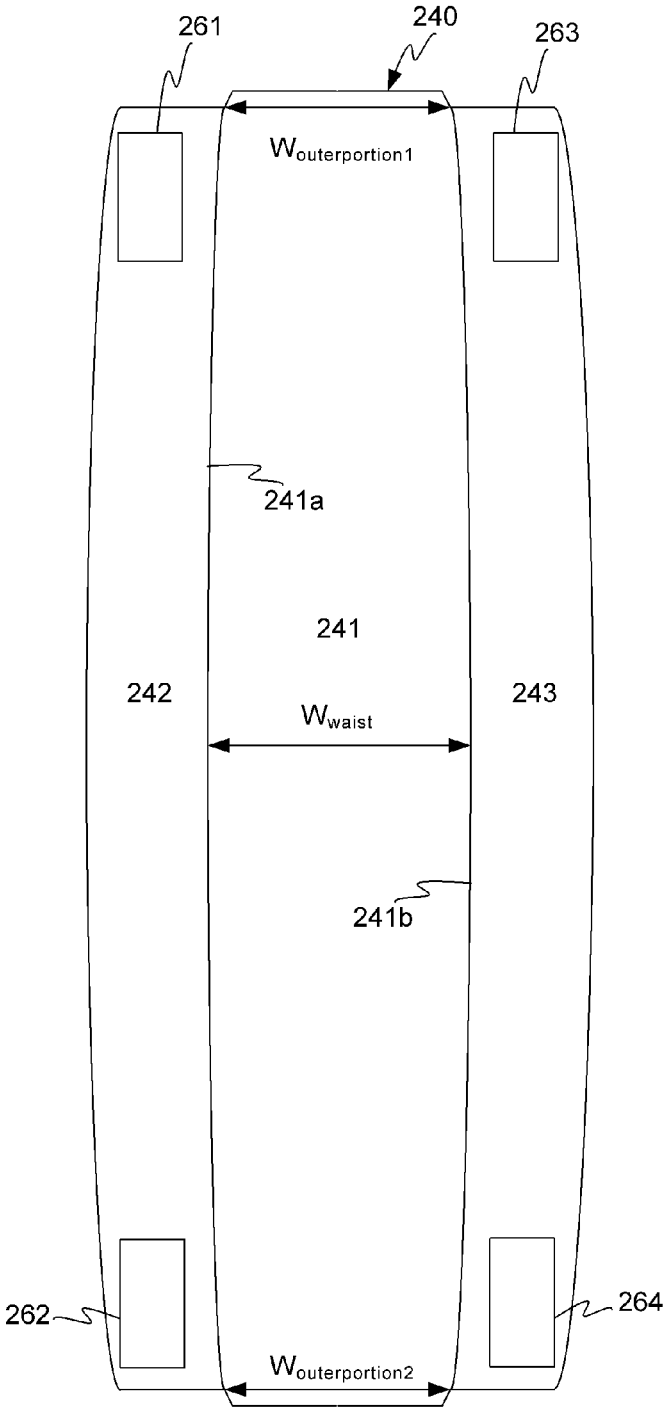
FIG. 6*a* shows a top view of a headband cover according to an embodiment (unfolded mode)
Figure 6B:
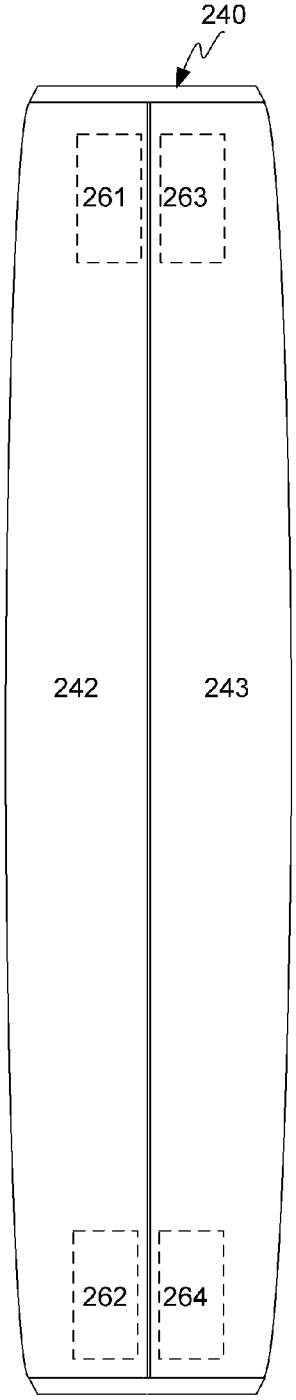
FIG. 6*b* shows a top view of the headband cover shown in FIG. 6*a* (folded mode)

With reference to FIGS. 6*a*-6*b*, another embodiment is disclosed. This embodiment is similar to the embodiment illustrated in FIGS. 5*a*-5*b*. Likewise, the second headband cover unit 242 may comprise one or several fastener elements 261, 262. Also, the third headband cover unit 243 may comprise one or several fastener elements 263, 264. Thereby, the second and third headband cover units 242, 243 may be securely attached to the headband 210 of the headphone 200 when the second and third headband portions 242, 243 are folded around the headband 210 of the headphone 200. In this embodiment, said one or several fastener elements 261, 262, 263, 264 are implemented by means of magnetic elements. As is schematically illustrated in the folded mode of the headband cover in FIG. 6*b*, a magnetic element 261 of the second headband cover unit 241 may securely attach, or connect, to a corresponding magnetic element 263 of the third headband cover unit 243 due to magnetic attraction between the magnetic elements 261 and 263, respectively. Likewise, another magnetic element 262 of the second headband cover unit 241 may securely attach, or connect, to a corresponding magnetic element 264 of the third headband cover unit 243 due to magnetic attraction between the magnetic elements 262, 264. In this embodiment, it may be an advantage to use rectangular-shaped magnetic elements 261-264 since this may facilitate the creation of the magnetic attraction between respective magnetic elements. However, other shapes of the magnetic elements 261-264 are also conceivable.

Figure 7A:
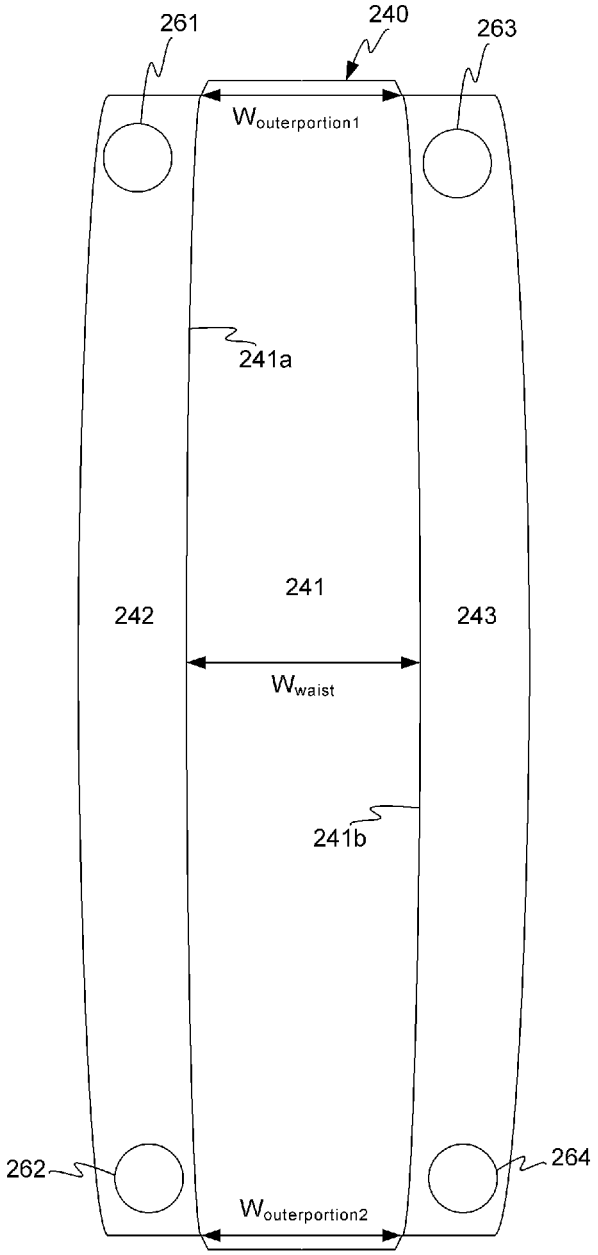
FIG. 7*a* shows a top view of a headband cover according to an embodiment (unfolded mode)
Figure 7B:
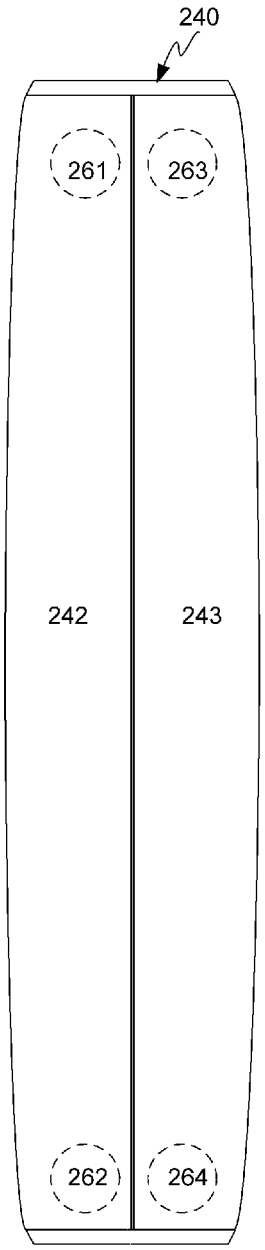
FIG. 7*b* shows a top view of the headband cover shown in FIG. 7*a* (folded mode)

With reference to FIGS. 7*a*-7*b*, yet another embodiment is disclosed. This embodiment is similar to the embodiment illustrated in FIGS. 6*a*-6*b*. In this embodiment, the magnetic elements are circular-shaped magnetic elements 261-264. The embodiment illustrated in FIGS. 7*a*-7*b* may e.g. be advantageous when used in combination with a headband 210 having extending legs 211*a*, 211*b* in the form of metal wires (see e.g. FIG. 2*b*). When folded around a headband 210, a magnetic attraction may be created between each one of the magnetic elements 261-264 and the metal wires 211*a*, 211*b*. Accordingly, the second and third headband cover units 242, 243 may be securely attached to the headband 210 by means of the magnetic attraction created between each one of the magnetic elements 261-264 and the metal wires 211*a*, 211*b*.

Advantageously, the headband cover 240 illustrated in FIGS. 3 through 7 has flexibility. This may be achieved in many different ways. By providing one or several headband cover units having flexibility it is made possible to allow for an easier folding of the headband cover around the headband of the headphone.

Figure 8A:
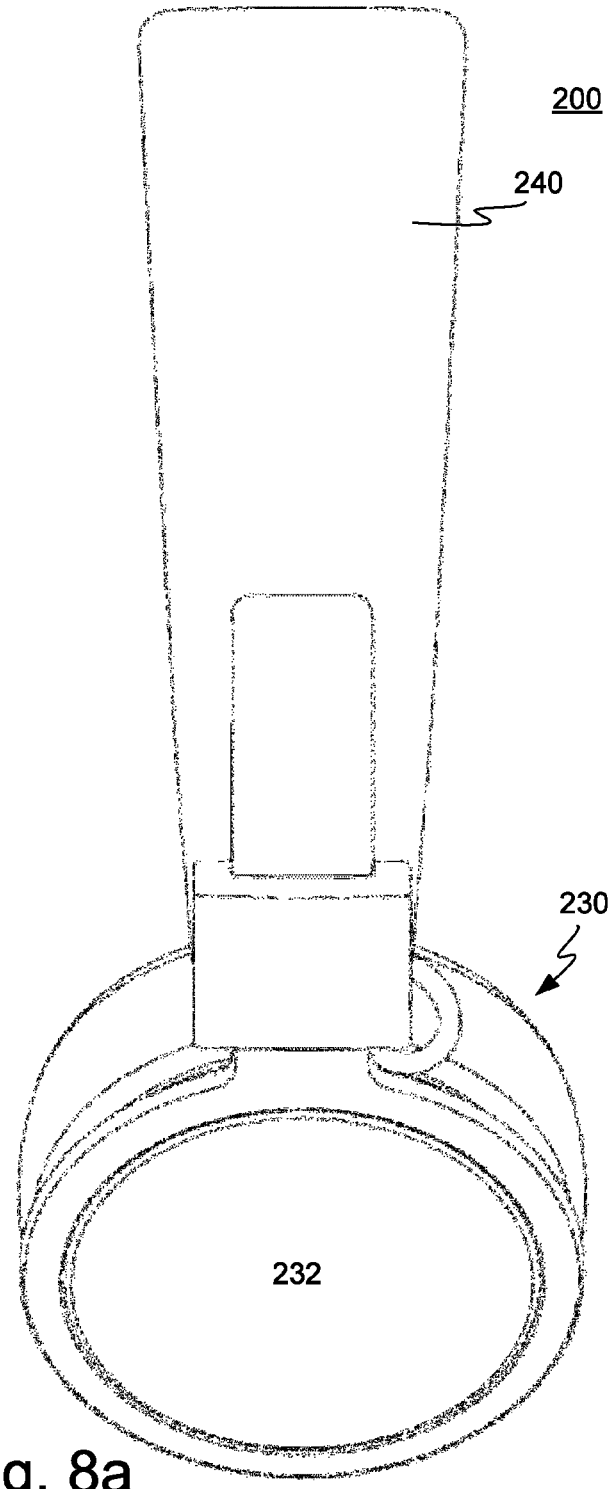
FIG. 8*a* shows a side view of the headphone illustrated in FIG. 2*a;*
Figure 8B:
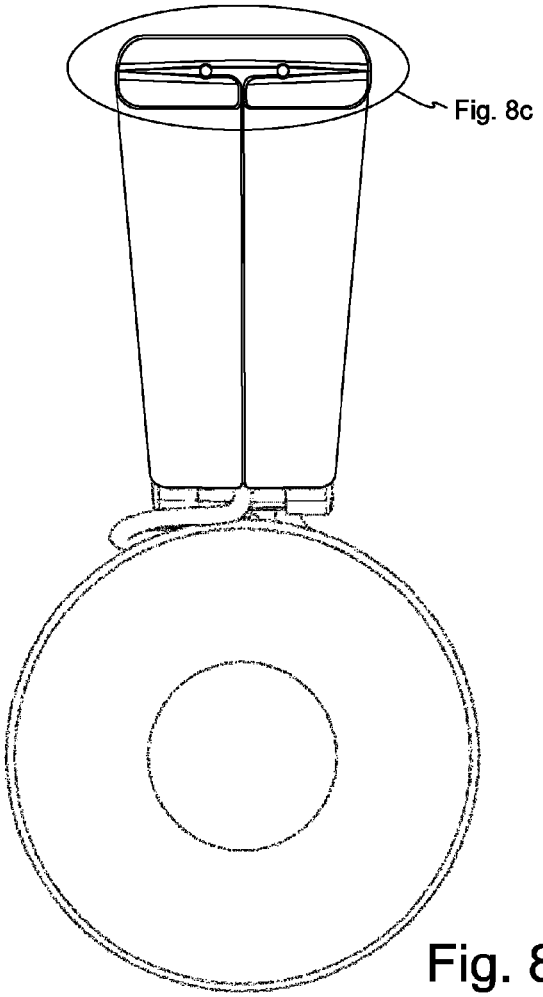
FIG. 8*b* shows a cross-section view of the headphone illustrated in FIG. 8*a*.
Figure 8C:
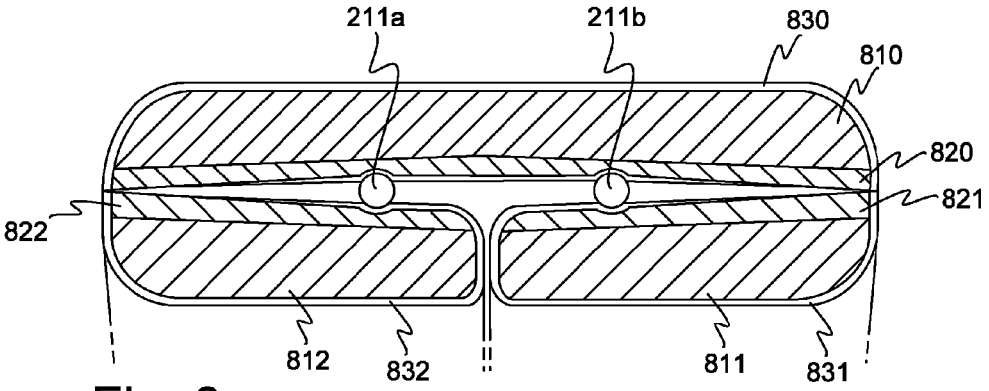
FIG. 8*c* is an enlarged view of the cross-section illustrated in FIG. 8*b*.

In some embodiments, at least one of the first, second and third headband cover units 241, 242, 243 has flexibility. Preferably, but not necessarily, all of the first, second and third headband cover units 241, 242, 243 have flexibility. In one example embodiment, which is schematically illustrated in FIGS. 8*a*-8*c*, all of the first, second and third headband cover units 241, 242, 243 have flexibility. In this embodiment, each of the first, second and third headband cover units 241, 242, 243 comprises a respective padding element 810, 811, 812. The padding element 810, 811, 812 may e.g. be made of foam. As mere examples, the foam may be PU foam or EVA foam. Also, each of the first, second and third headband cover units 241, 242, 243 comprises a bendable plastic element 820, 821, 822, which abuts against its respective padding element 810, 811, 812. Advantageously, but not necessarily, the bendable plastic element 820, 821, 822 may be attached to its respective padding element 810, 811, 812 by means of an adhesive. The bendable plastic element 820, 821, 822 may be made of polypropylene (PP), or any other flexible polymer material (e.g., polyethylene terephthalate (PET), polyvinyl chloride (PVC), polycarbonates (PC)). Other flexible materials could also be conceivable. Furthermore, each of the first, second and third headband cover units 241, 242, 243 comprises clothing 830, 831, 832 covering its respective padding element 810, 811, 812 and its respective bendable plastic element 820, 821, 822. The clothing may advantageously be made of fabric. Alternatively, the clothing may be made of leather, or artificial leather.

For example, the respective padding elements 810, 811, 812 and bendable plastic elements 820, 821, 822 may be covered by its respective clothing 831, 832, 832 by sewing the respective padding elements 810, 811, 812 and bendable plastic elements 820, 821, 822 into respective clothing 831, 832, 832. A first seam may be provided along the first longitudinal side 241*a* and a second seam may be provided along the second longitudinal side 241*b*, see e.g. FIGS. 3*a*, 4*a*, 5*a*, 6*a* and 7*a*, respectively. Accordingly, the second headband cover unit 242 may be foldable along the first seam and the third headband cover unit 243 may be foldable along the second seam such that the second and third headband units 242, 243 may be folded around the headband 210 of the headphone 200 to detachably attach the headband cover 240 to the headband 210 of the headphone 200.

In some embodiments, such as the embodiment illustrated in FIGS. 7*a*-7*b* where the fastener elements are implemented by means of magnetic elements, the magnetic elements 261-624 may advantageously by covered by clothing 831, 832 by sewing the magnetic elements 261-264 into the respective clothing 831, 832.

Selected Example Embodiments Described Herein

The technology described in this disclosure thus encompasses without limitation the following Numbered Example Embodiments (NEE's):

NEE1

A headband cover (240) for detachable attachment to a headband (210) of a headphone (200), the headband (210) being configured to extend along a portion of a head of a wearer of the headphone (200), the headband cover (240) comprising:

a first headband cover unit (241);

a second headband cover unit (242), which is arranged along a first longitudinal side (241*a*) of the first headband cover unit (241); and a third headband cover unit (243), which is arranged along a second longitudinal side (241*b*) of the first headband cover unit (241), the second longitudinal side (241*b*) being an opposite side to the first longitudinal side (241*a*); wherein the second headband cover unit (242) is foldable along the first longitudinal side (241*a*) of the first headband cover unit (241) and the third headband cover unit (243) is foldable along the second longitudinal side (241*b*) of the first headband cover unit (241) such that the second and third headband units (242; 243) can be folded around the headband (210) of the headphone (200) to detachably attach the headband cover (240) to the headband (210) of the headphone (200).

NEE2

The headband cover (240) according to NEE1, wherein the first headband cover unit (241) has a waist portion (241*c*) whose width ($W_{waist}$), along a direction (L) perpendicular to the first and second longitudinal sides (241*a*; 241*b*), is wider than corresponding widths ($W_{outerportion1}$; $W_{outerportion2}$) at respective outer portions (241*d*; 241*e*) of the first headband cover unit (241), the outer portions (241*d*; 241*e*) of the first headband cover unit (241) being positioned at either side of the waist portion (241*c*).

NEE3

The headband cover (240) according to NEE1 or NEE2, wherein at least one of the first, second and third headband cover units (241; 242; 243) has flexibility.

NEE4

The headband cover (240) according to NEE3, wherein said at least one of the first, second and third headband cover units (241; 242; 243) comprises:

a padding element (810; 811, 812);

a bendable plastic element (820; 821; 822) abutting against the padding element (810; 811, 812); and clothing (830, 831, 832) covering the padding element (810; 811, 812) and the bendable plastic element (820; 821, 822).

NEE5

The headband cover (240) according to NEE1 or NEE2, wherein all of the first, second and third headband cover units (241; 242; 243) have flexibility.

NEE6

The headband cover (240) according to NEE5, wherein each one of the first, second and third headband cover units (241; 242; 243) comprises:

a padding element (810; 811, 812);

a bendable plastic element (820; 821; 822) abutting against the padding element (810; 811, 812); and clothing (830, 831, 832) covering the padding element (810; 811, 812) and the bendable plastic element (820; 821, 822).

NEE7

The headband cover (240) according to NEE4 or NEE6, wherein the padding element (810; 811, 812) is made of foam.

NEE8

The headband cover (240) according to NEE4, NEE6 or NEE7, wherein the bendable plastic element (820; 821; 822) is made of polypropylene, PP.

NEE9

The headband cover (240) according to NEE4, NEE6, NEE7 or NEE8, wherein the bendable plastic element (820; 821; 822) is attached to the padding element (810; 811, 812) by means of an adhesive.

NEE10

The headband cover (240) according to NEE4, NEE6, NEE7, NEE8 or NEE9, wherein the clothing (830, 831, 832) is made of fabric, leather, or artificial leather.

NEE11

The headband cover (240) according to any one of the NEE's 1-10, wherein the second headband cover unit (242) comprises at least one fastener element (251, 252; 261, 262); and wherein the third headband cover (243) unit also comprises at least one fastener element (253, 254; 263, 264) such that the second and third headband cover units (242; 243) can be securely attached to the headband (210) of the headphone (200) when the second and third headband units (242; 243) are folded around the headband (210) of the headphone (200).

NEE12

The headband cover (240) according to NEE11, wherein said at least one fastener element (251, 252, 253, 254; 261, 262, 263, 264) is a hook-and-loop fastener element.

NEE13

The headband cover (240) according to NEE11, wherein said at least one fastener element (251, 252, 253, 254; 261, 262, 263, 264) is a magnetic element.

NEE14

The headband cover (240) according to any one of the NEEs 1-13, wherein:

a first width (W1) of the second headband cover unit (242) corresponds to substantially half the length of a corresponding width (W3) of the first headband cover unit (241); and wherein a second width (W2) of the third headband cover unit (243) corresponds to substantially half the length of a corresponding width (W3) of the first headband cover unit (241); whereby the total length of said first and second widths (W1; W2) substantially equals the corresponding width (W3) of the first headband cover unit (241) when the second and third headband units (242; 243) are folded around the headband (210) of the headphone (200).

NEE15

A headband (210) for a headphone (200), the headband (210) being configured to extend along a portion of a head of a wearer of the headphone (200), and wherein a headband cover (240) according to any one of the NEE's 1-14 is detachably attached to the headband (210).

NEE16

The headband (210) according to NEE15, comprising at least two legs (211*a*; 211*b*) that extend in a curvature corresponding to said portion of the head of the wearer of the headphone (200).

NEE17

The headband (210) according to NEE16, wherein each of the at least two legs (211*a*; 211*b*) is a metal wire.

NEE18

The headband (210) according to any one of the NEE's 15-17, wherein each headband end (220) is provided with hook-and-loop fastener elements (221) configured to detachably attach with corresponding hook-and-loop fastener elements of the headband cover (240).

NEE19

A headphone (200) comprising a headband (210) according to any one of the NEE's 15-18.

Modifications and other variants of the described embodiments will come to mind to one skilled in the art having benefit of the teachings presented in the foregoing description and associated drawings. Therefore, it is to be understood that the embodiments are not limited to the specific example embodiments described in this disclosure and that modifications and other variants are intended to be included within the scope of this disclosure. For example, while embodiments of the invention have been described with reference to headphones, persons skilled in the art will appreciate that the embodiments of the invention may equivalently be applied to similar ear devices including, for example, ear protectors. Furthermore, although specific terms may be employed herein, they are used in a generic and descriptive sense only and not for purposes of limitation. Therefore, a person skilled in the art would recognize numerous variations to the described embodiments that would still fall within the scope of the appended claims. As used herein, the terms "comprise/comprises" or "include/includes" do not exclude the presence of other elements or steps. Furthermore, although individual features may be included in different claims (or embodiments), these may possibly advantageously be combined, and the inclusion of different claims (or embodiments) does not imply that a certain combination of features is not feasible and/or advantageous. In addition, singular references do not exclude a plurality. Finally, reference signs in the claims are provided merely as a clarifying example and should not be construed as limiting the scope of the claims in any way.

What is claimed is:

1. A headband cover for detachable attachment to a headband of a headphone, the headband being configured to extend along a portion of a head of a wearer of the headphone, the headband cover comprising:

a first headband cover unit;

a second headband cover unit, which is arranged along a first longitudinal side of the first headband cover unit; and a third headband cover unit, which is arranged along a second longitudinal side of the first headband cover unit, the second longitudinal side being an opposite side to the first longitudinal side; wherein the second headband cover unit is foldable along the first longitudinal side of the first headband cover unit and the third headband cover unit is foldable along the second longitudinal side of the first headband cover unit such that the second and third headband units can be folded around the headband of the headphone to detachably attach the headband cover to the headband of the headphone, wherein the first headband cover unit has a waist portion whose width, along a direction perpendicular to the first and second longitudinal sides, is wider than corresponding widths at respective outer portions of the first headband cover unit, the outer portions of the first headband cover unit being positioned at either side of the waist portion.

2. The headband cover according to claim 1, wherein at least one of the first, second and third headband cover units has flexibility.

3. The headband cover according to claim 2, wherein said at least one of the first, second and third headband cover units comprises:

a padding element;

a bendable plastic element abutting against the padding element; and clothing covering the padding element and the bendable plastic element.

4. The headband cover according to claim 1, wherein all of the first, second and third headband cover units have flexibility.

5. The headband cover according to claim 4, wherein each one of the first, second and third headband cover units comprises:

a padding element;

a bendable plastic element abutting against the padding element; and clothing covering the padding element and the bendable plastic element.

6. The headband cover according to claim 3, wherein the padding element is made of foam.

7. The headband cover according to claim 6, wherein the bendable plastic element is made of polypropylene.

8. The headband cover according to claim 7, wherein the bendable plastic element is attached to the padding element by an adhesive.

9. The headband cover according to claim 8, wherein the clothing is made of fabric, leather, or artificial leather.

10. The headband cover according to claim 5, wherein the padding element is made of foam.

11. The headband cover according to claim 10, wherein the bendable plastic element is made of polypropylene.

12. The headband cover according to claim 11, wherein the bendable plastic element is attached to the padding element by an adhesive.

13. The headband cover according to claim 12, wherein the clothing is made of fabric, leather, or artificial leather.

14. The headband cover according to claim 1, wherein the second headband cover unit comprises at least one fastener element; and wherein the third headband cover unit also comprises at least one fastener element such that the second and third headband cover units can be securely attached to the headband of the headphone when the second and third headband units are folded around the headband of the headphone.

15. The headband cover according to claim 14, wherein said at least one fastener element is a hook-and-loop fastener element.

16. The headband cover according to claim 14, wherein said at least one fastener element is a magnetic element.

17. The headband cover according to claim 1, wherein:

a first width of the second headband cover unit corresponds to substantially half the length of a corresponding width of the first headband cover unit; and wherein a second width of the third headband cover unit corresponds to substantially half the length of a corresponding width of the first headband cover unit;

whereby the total length of said first and second widths substantially equals the corresponding width of the first headband cover unit when the second and third headband units are folded around the headband of the headphone.

18. A headphone comprising a headband, the headband being configured to extend along a portion of a head of a wearer of the headphone, and wherein a headband cover according to claim 1 is detachably attached to the headband.

19. The headphone according to claim 18, wherein the headband comprises at least two legs that extend in a curvature corresponding to said portion of the head of the wearer of the headphone and wherein each one of the at least two legs is a metal wire.

* * * * *